US005273362A

United States Patent [19]

Buchanan

[11] Patent Number: 5,273,362

[45] Date of Patent: Dec. 28, 1993

[54] STAND UP PLASTIC BAG AND METHOD OF MANUFACTURE

[75] Inventor: Jerry E. Buchanan, Alpharetta, Ga.

[73] Assignee: Jebco Packaging Systems, Inc., Tucker, Ga.

[21] Appl. No.: 916,889

[22] Filed: Jul. 20, 1992

Related U.S. Application Data

[63] Continuation-in-part of Ser. No. 517,787, May 2, 1990, Pat. No. 5,135,464.

[51] Int. Cl.[5] ..... B65D 30/16; B65D 30/20; B31B 25/28; B31B 35/20

[52] U.S. Cl. ..... 383/104; 383/120; 383/122; 493/199; 493/195; 493/936

[58] Field of Search ..... 493/133, 189, 194, 195, 493/199, 200, 227, 231, 232, 243, 245, 261, 936; 383/104, 119, 121.1, 123, 124, 125, 126, 120, 122

[56] References Cited

U.S. PATENT DOCUMENTS

| | | | |
|---|---|---|---|
| 520,951 | 6/1894 | Claussen | 493/243 |
| 2,092,858 | 9/1937 | Richard | 93/35 |
| 2,162,258 | 6/1939 | Hultin | 229/55 |
| 2,283,069 | 5/1942 | Knuetter . | |
| 3,136,475 | 6/1964 | Geimer . | |
| 3,282,411 | 11/1966 | Jardine | 206/46 |
| 3,387,701 | 6/1968 | Schneider et al. | 206/46 |
| 3,390,829 | 7/1968 | Malby et al. . | |
| 3,412,925 | 11/1968 | Booth et al. . | |
| 3,437,258 | 4/1969 | Kugler . | |
| 3,534,520 | 10/1970 | Moran . | |
| 3,534,666 | 10/1970 | Maccherone . | |
| 3,612,133 | 10/1971 | Jarund . | |
| 3,618,478 | 11/1971 | Pizazze . | |
| 3,715,074 | 2/1973 | Michel . | |
| 3,750,937 | 8/1973 | Goodwin . | |
| 3,764,000 | 10/1973 | Jentsch . | |
| 3,829,007 | 8/1974 | Ellison . | |
| 3,917,159 | 11/1975 | Platz et al. . | |
| 3,980,225 | 9/1976 | Kan . | |
| 4,055,109 | 10/1977 | Kan . | |
| 4,082,216 | 4/1978 | Clarke | 229/55 |
| 4,189,089 | 2/1980 | Langen et al. | 229/61 |
| 4,453,370 | 6/1984 | Titchenal . | |
| 4,747,703 | 5/1988 | Cazes . | |
| 4,810,109 | 3/1989 | Castel . | |
| 4,837,849 | 6/1989 | Erickson et al. . | |
| 4,904,093 | 2/1990 | Woods et al. . | |
| 4,932,556 | 6/1990 | Hui et al. . | |

FOREIGN PATENT DOCUMENTS

| | | |
|---|---|---|
| 1376038 | 2/1955 | Fed. Rep. of Germany . |

*Primary Examiner*—William E. Terrell
*Attorney, Agent, or Firm*—Kennedy & Kennedy

[57] ABSTRACT

Containers are produced from a sheet of flexible material having a thermally bondable inside surface. In one embodiment flaps are formed and folded outwardly to form two windows in the sheet. Pleats are formed and bonded to transverse the windows so that a pleat ply closes the windows. The pleats are folded to bring the flaps against the window closing pleat plies and bonded. In another emobdiment holes are cut in the sheet located in one ply of the pleats.

8 Claims, 17 Drawing Sheets

200
202
204
204

202
A
A
B
205
208
201
A'
B'
209
206

205
A
B
208
209
206
A'
B'
201

205
B
A
A'
B'

202
205
206
B
A
A'
B'
201
211
212

205
A
A'

208
A
206
209
205
B'
B
A
A'

A
A'
205
211'
205
B
206
212
206
B'
A'
A 215
216
202
215
216
215
216

202
205
A
A'

STAND UP PLASTIC BAG AND METHOD OF MANUFACTURE

REFERENCE TO RELATED APPLICATION

This is a continuation-in-part of application Ser. No. 517,787 filed May 2, 1990, U.S. Pat. No. 5,135,464.

TECHNICAL FIELD

The present invention relates to the packaging industry, and more particularly to a flexible container, as well as a method for making same.

Traditional means for packaging products, particularly liquids, have included metal cans and glass and plastic bottles. Cans and bottles have the advantage of being hermetically sealable, are of sturdy construction, and may be stored in a self-supported upright position.

However, a number of problems exist in the use of cans and bottles. For example, their production methods are complicated and expensive. The raw materials used in producing such containers are also expensive.

Furthermore, traditional cans and bottles present environmental problems in that, even in their empty state, they occupy a relatively large amount of space, whether it be at a landfill or in a kitchen garbage can. Finally, cans and bottles are rather heavy and therefore are inconvenient and expensive to transport.

BACKGROUND ART

In an attempt to overcome the reliance upon cans and bottles, packages have recently begun to use flexible, fusible sheet material in forming disposable containers, such as found in U.S. Pat. No. 3,380,646 to Doyen et al and U.S. Pat. No. 4,287,247 to Reil et al. Such containers are problematic, however, in that they have interior crevices in their bottoms and corners which may act as bacterial traps. Furthermore, they must be produced from relatively thick, and therefore expensive, retort material to be capable of standing upright without support. Even if manufactured with such thick material, the packages are typically unstable and must be supported on the shelves of a store by a box or other means. Once purchased and opened, consumers have to empty the contents of the containers into pitchers or other storage means. Also, the flexible containers used to date usually have at least one weld on their interior bottom wall, which is the location of the most pressure from liquid or other packaged products. As a result, there is a structural weakness at the bottom portions of most currently used containers.

The methods employed in producing the currently used flexible containers are complicated in that they require a relatively large number of welding steps, many of which must be performed while the container material is in a vertical orientation. As a result, the apparatus for forming the container is by necessity complicated and expensive.

There exists a need, therefore, for a container which is hermetically sealable, lightweight, and which is flexible so as not to occupy a large volume of space when emptied.

There exists a further need for a flexible container which has no interior crevices, which can be produced from relatively thin material, and which is sturdy, particularly along its bottom.

There also exists a need for a method of producing such a container which provides effective seals yet is simple, quick and inexpensive.

DISCLOSURE OF THE INVENTION

The present invention relates to a container having a front wall, a rear wall, a pair of sidewalls, and a reinforced bottom wall. The bottom wall is preferably comprised of a plurality of folded leg members extending from the lower edges of the front and rear walls. The lower portions of the sidewalls are reinforced with the folded-up endmost portions of the folded leg members. The top edges of the container may be welded closed to form a hermetically sealed package.

A method of making a container from flexible material comprises placing a V-fold, or a modified flat V-fold, in a sheet of flexible material to form an intermediate structure having a first subsection, a second subsection underlying the first subsection and a V-fold section intermediate the first and lower edge of the second subsections having a first V-fold member attached to the lower edge of the first subsection and a second V-fold member attached to the lower edge of the second subsection. The first and second V-fold members are preferably connected along a longitudinal fold line.

A first side edge weld line is made connecting the upper edges with the lower edges to weld the first subsection to both the second subsection and the first V-fold member and at the same time to weld the second subsection to the second V-fold member. A second side edge weld line is made a distance from the first side edge weld line connecting the upper edges with the lower edges to weld the first subsection to both the second subsection and the first V-fold member and at the same time to weld the second subsection to the second V-fold member. The side edge welds result in the formation of an upper container portions and first and second leg portions, which are connected along the first fold line.

A first oblique weld line is made interconnecting the point of intersection of the first weld line and the first fold line to the lower edge of the first subsection. A second oblique weld line is made interconnecting the point of intersection of the second side edge weld line and the longitudinal fold line to the lower edge of the first subsection. A leg weld line may be made between the first and second side edge weld lines at approximately the middle point of the first leg to weld the first subsection to both the first V-fold member and the second subsection the second V-fold member.

The bottom wall is formed by folding the first leg inwardly towards the first fold line so that the lower edge of the first subsection is adjacent the first fold line and folding the second leg inwardly towards the first fold line so that the lower edge of the second subsection is adjacent the longitudinal fold line. Upon separating the first subsection from the second subsection, an interior space is formed between the first and second side edge weld lines and the endmost portions of the legs pivot along the lateral axis of the bottom wall upwardly towards the first and second side edge weld lines. One of the endmost portions is attached to the first side edge weld line and the remaining endmost portion is attached to the second side edge weld line to form reinforced container side edges.

The container of the present invention has a number of significant attributes. For example, the bottom and lower side walls of the container, which are subjected to the most pressure by the contents of the container, are reinforced by multiple plies of container material, yet the container bottom is free from any debilitating internal weld. The present container may also have deeper side walls than those previously known.

Furthermore, the container can be produced from relatively thin material and therefore is lighter and less expensive to manufacture and transport than containers requiring thick material. This is especially useful when the container is made from flexible material, which is expensive. The thinness of the container walls also encourages the use of biodegradable materials, which have traditionally been thin. Still, the container is capable of standing vertically on its own, both during the filling process and when on a grocery or refrigerator shelf without the need of an outer box or other supporting means. The present invention therefore eliminates the need for transferring the contents into a pitcher or other containment means after opening. The fact that there are no crevices in the interior of the container minimizes the worry about bacteria-traps when storing the opened container between uses. This also enables the container to be used as a mixing bowl, such as for foods or other items to which water is added.

Also, once the product is used and the container is empty, the walls of the container will collapse back to its flat state. This will result in the waste container occupying far less volume in the family trash, as well as in a landfill, than the commonly used can or plastic bottle.

The method of producing the present invention is also advantageous. For example, the entire container may, in one embodiment, be produced using a single web of material. Also, the number of welds needed to be made are minimized and the entire production process prior to filling may, if desired, be performed while the web material is traveling in a horizontal plane.

Overall, the container of the present invention possesses many of the attributes of a can or bottle, but at the same time eliminates many of the negatives. Also, the method of manufacturing of the present invention is efficient and inexpensive.

BEST MODE OF CARRYING OUT THE INVENTION

Figure 1:
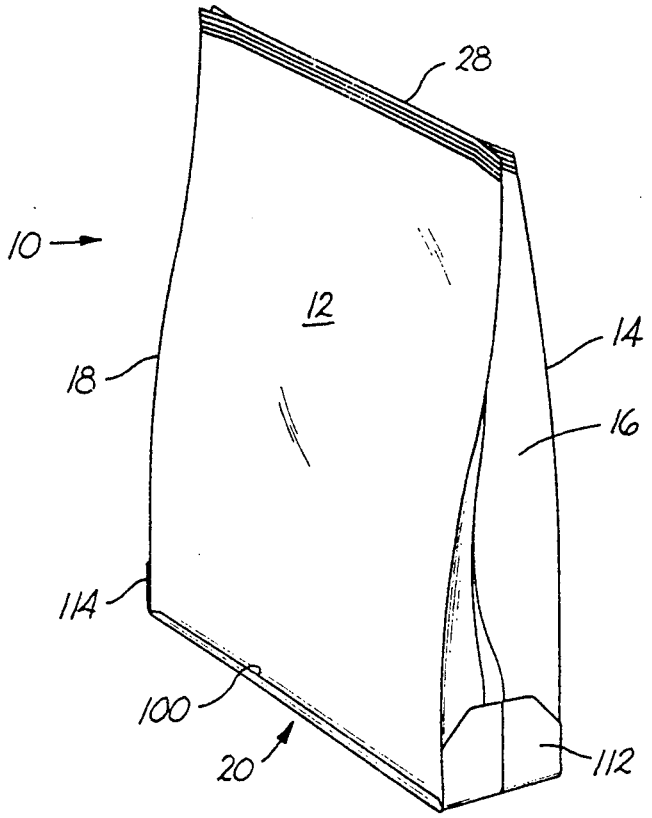
FIG. 1 is a perspective view of one embodiment of the container of the present invention.
Figure 12:
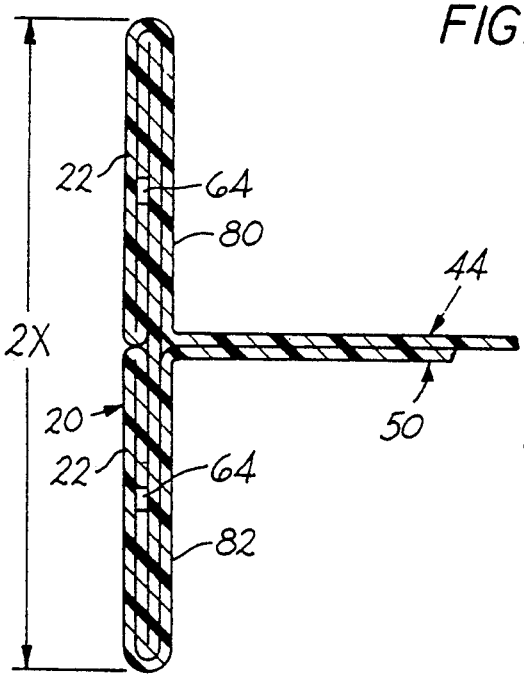
FIG. 12 is a cross-sectional view of the lower portion of the container of the present invention in its collapsed state.

FIG. 1 illustrates a flexible container 10 of the present invention. The container 10 has a front wall 12, a rear wall 14, a pair of sidewalls 16, 18 and a reinforced bottom wall 20. As illustrated in FIG. 12, the bottom wall 20 is preferably comprised of a pair of folded leg members 80, 82 extending from the lower edges of the front and rear walls 12, 14. The lower portions of the sidewalls 16, 18 are reinforced with endmost portions 112,114, which are integral with the folded leg members 80, 82. The top edge 28 of the container 10 may be welded closed to form a hermetically sealed package. Leg weld line 100*a* is located at the intersection of the front wall 12 and the bottom wall 20, and leg weld line 100*b* is located at the intersection of the rear wall 14 and the bottom wall 20, both for further maintaining the container 10 in upright position. The weld lines 100*a,b* also reinforce the intersection of the front wall 12 and the bottom wall 20 and prevent flex-cracking of container material, particularly aluminum foil type material.

Figure 2:
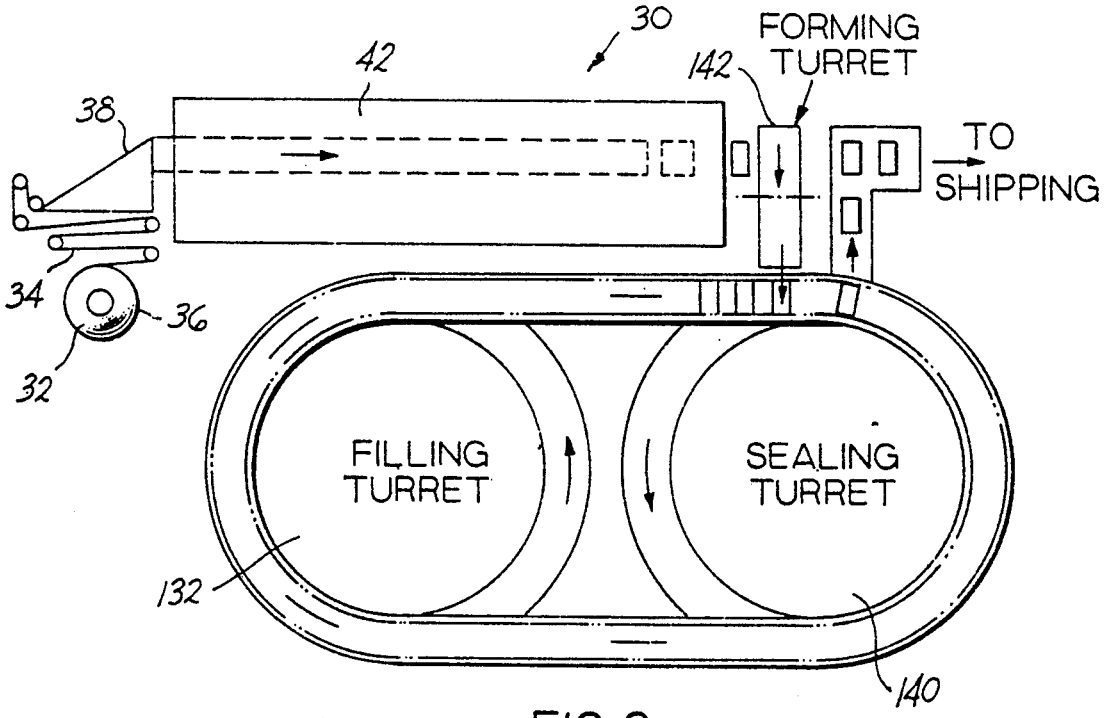
FIG. 2 is a schematic of an apparatus for manufacturing the container of the present invention.

FIG. 2 illustrates an apparatus 30 which may be used to manufacture the container 10 of the present invention. A single web 32 of container material 34 is delivered from a roller 36 to a standard V-plow 38. The V-plow 38 creates a V-fold in the approximate center of the material 34, such as shown in FIG. 3, and the material 34 is passed through the remaining processes along a conveyor belt 42, preferably in a horizontal orientation.

Figure 3:
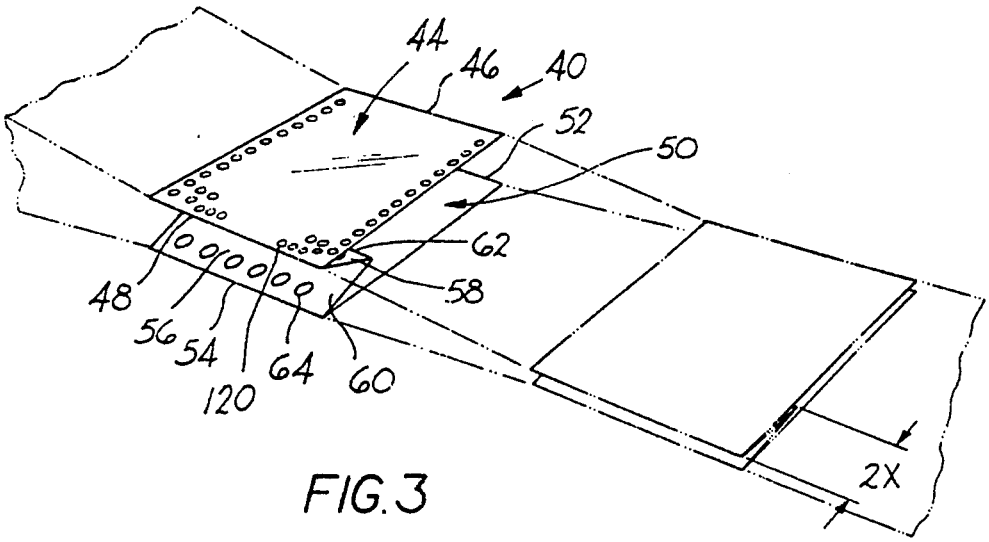
FIG. 3 is a perspective view of one embodiment of the intermediate structure of the container of the present invention.

As shown in FIG. 3, an intermediate structure 40 has a first subsection 44 having an upper edge 46 and a lower edge 48, a second subsection 50 underlying the first subsection 44 and having an upper edge 52 and a lower edge 54, and a V-fold section 56 intermediate the first subsection 44 and the second subsection 50. The V-fold section 56 includes a first V-fold member 58 attached to the lower edge 48 of the first subsection 44 and a second V-fold member 60 attached to the lower edge 54 of the second subsection 50. The top edge of the first V-fold member 58 is connected to the top edge of the second V-fold member 60 along a common point such as first fold line 62. The length of the member 58, 60 may be identical or different. For example, the length of each of the V-fold members 58, 60 in the present embodiment is 2×. The intermediate structure 40 is capable of being collapsed into a relatively flat, multiple-plied structure, so that a single weld made on the first subsection may produce weld lines on both the first and second subsection 44, 50.

Figure 4:
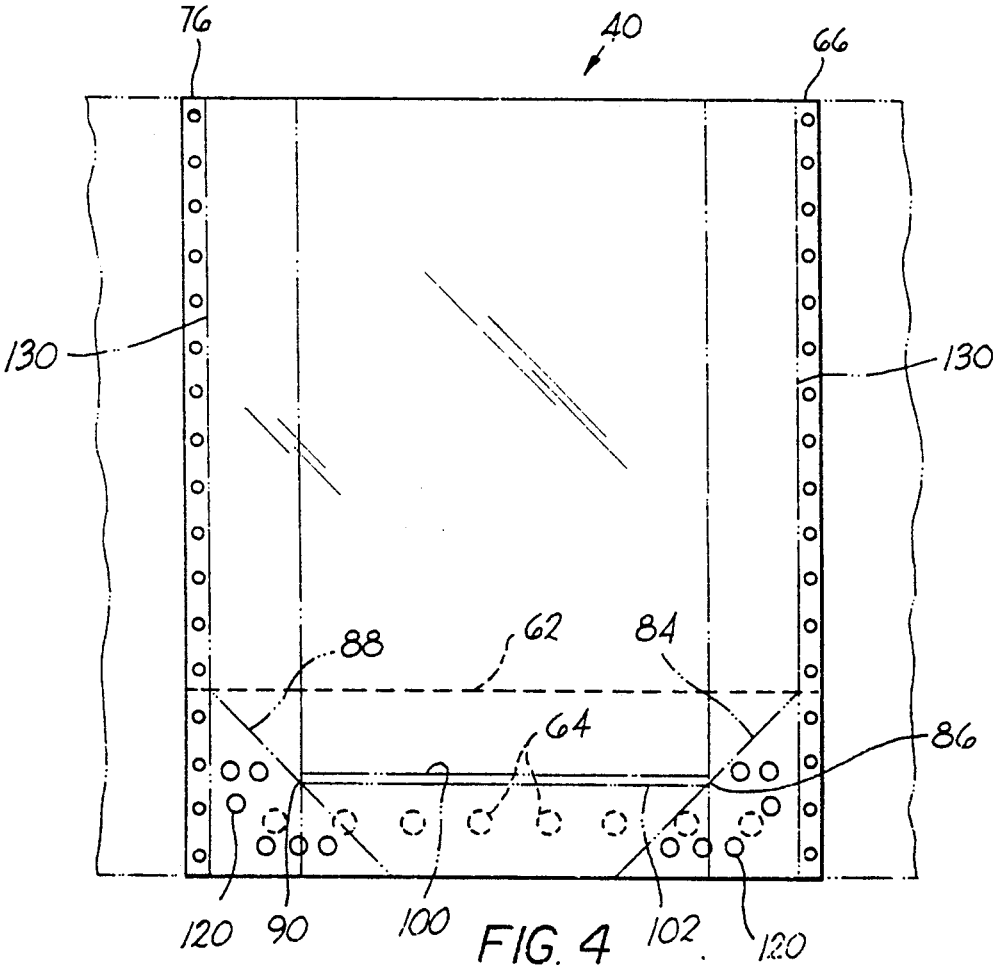
FIG. 4 is a top view of one embodiment of the intermediate structure of the container of the present invention.

The container 10 is preferably comprised of a two-ply laminated material, such as a coextruded solid sheet of low density/high density polyethylene or a laminated multilayered sheet. Typically this material will have an inner ply which is plastic, and hence heat-sealable, and an outer ply which is not. In the steps of manufacturing the container 10, it is sometimes necessary to attach one surface of the intermediate structure 40 to another. This attachment may be accomplished with adhesives, or may alternatively be accomplished by other means of attaching one surface to another, such as standard cold or heat-sealing. To the extent that heat sealing is used, it may be necessary to expose the heat-sealable inner ply by removing the outer-ply at a point of attachment. For example, weld-spots 64, 120 and 130 are shown in FIG. 3 and 4 at positions which will eventually be attachment points for forming the container 10. Also, the term weld used herein is defined as any means of attaching one surface to another.

Figure 5:
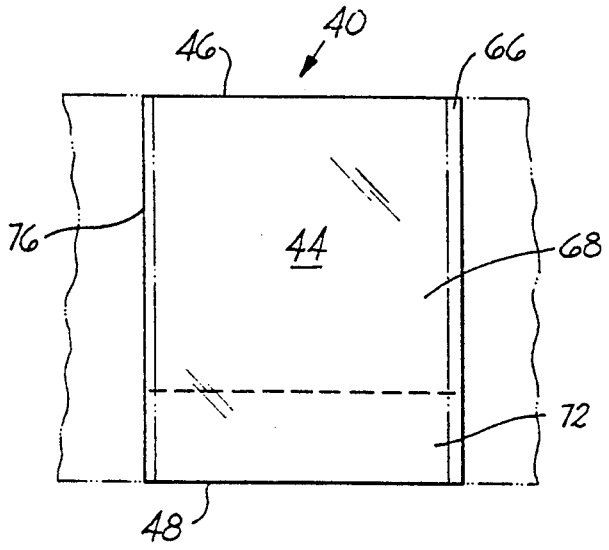
FIG. 5 is a top view of one embodiment of the intermediate structure of the container of the present invention illustrating the preferred position of the side edge weld lines.
Figure 6:
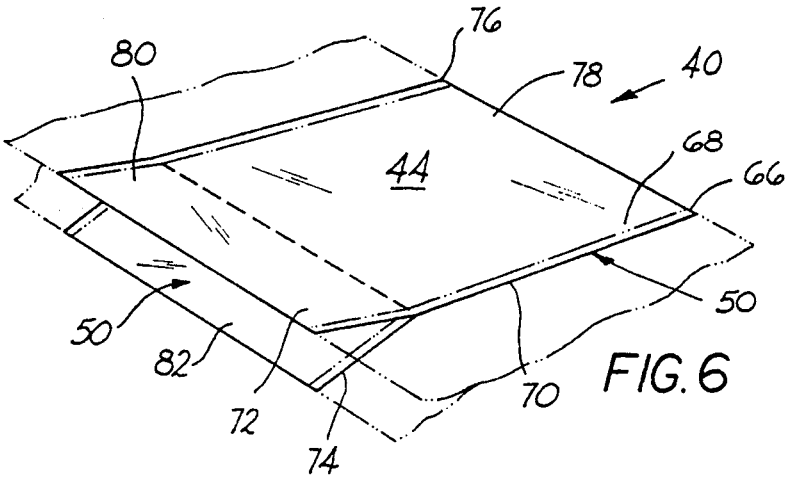
FIG. 6 is a perspective view of the intermediate structure of FIG. 5 illustrating separated legs.

As shown in FIGS. 5 and 6, once the V-fold section 56 is formed, a first side edge weld line 66 is placed made connecting the juxtaposed upper edges 46, 52 and lower edges 48, 54. The line 66 should be relatively thick, for example about one-half inch thick, so that it may be later cut in half while maintaining its seal. The result of the first side edge weld line 66 will be the attachment of the upper portion 68 of the first subsection 44 to the upper portion 70 of the second subsection 50, the lower portion 72 of the first subsection 44 to the first V-fold member 58 and the lower portion 74 of the second subsection 50 to the second V-fold member 60. Similarly, a second side edge weld line 76 is made at a distance away from the first side edge weld line 66. The result of the second weld line 76 will also be and connecting upper edges 48, 54 and lower edges 48, 52 the attachment of the upper portion 68 of the first subsection 44 to the upper portion 70 of the second subsection 50, the lower portion 72 of the first subsection 44 to the first V-fold member 58 and the lower portion 74 of the second subsection 50 to the second V-fold member 60. The first and second side edge welds 66,76 will thereby form an upper container portion 78, a first leg portion 80 and a second leg portion 82, as shown in FIG. 6.

Figure 7:
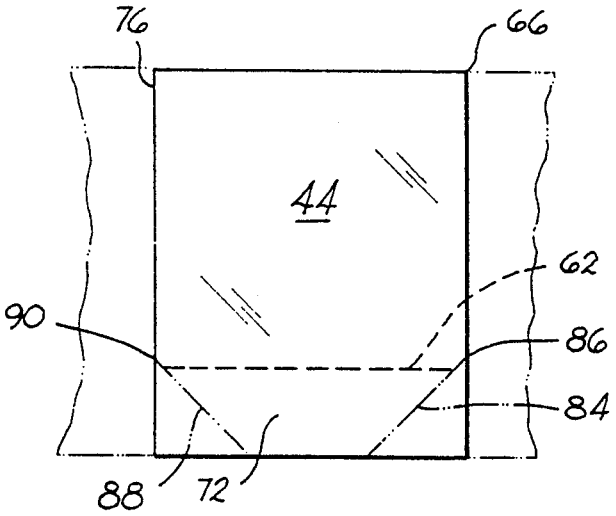
FIG. 7 is a top view of the intermediate structure of FIG. 4 illustrating the preferred position of the oblique weld lines.
Figure 8:
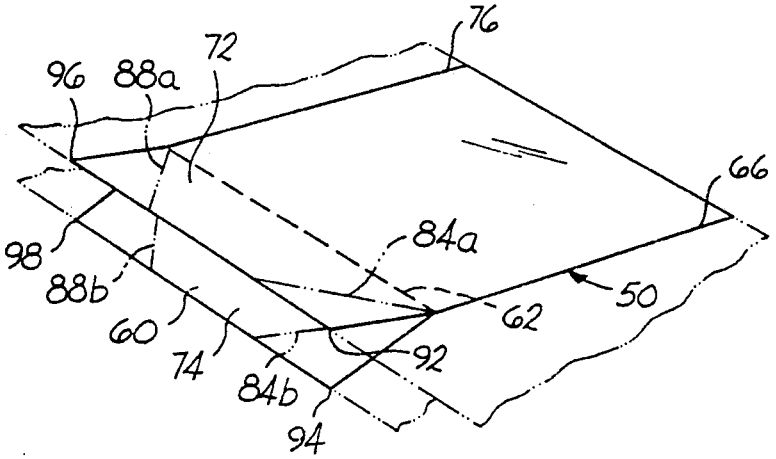
FIG. 8 is a perspective view of the intermediate structure of FIG. 7 illustrating separated legs.

As shown in FIGS. 7 and 8, in the present embodiment, a first oblique weld line 84 is placed interconnecting the common point 86 of intersection of the first side edge weld line 66 and the top edges of the V-fold members 58, 60, when the subsections 44, 50 are in underlying position, to the lower edge 48 of the first subsection 44. When the V-fold members 58, 60 are attached along the first fold line 62, the common point 86 will also be the intersection of the first fold line 62 and weld line 66. The first oblique weld line 84 results in the attachment of the lower portion 72 of the first subsection 44 to the first V-fold member 58 along line 84*a* and the lower portion 74 of the second subsection 50 to the second V-fold member 60 along line 84*b*. Similarly, a second oblique weld line 88 is placed interconnecting the point 90 of intersection of the second side edge weld line 76 and top edges and the lower edge 48. The second oblique weld line 88 results in the attachment of the lower portion 72 of the first subsection 44 to the first V-fold member 58 along line 88*a* and the lower portion 74 of the second subsection 50 to the second V-fold member 60 along line 88*b*. Both the first and second oblique weld lines 86,88 should be at approximately 45° angles. Additionally, the entire area between the first oblique weld lines 84*a,b* and corners 92, 94, as well as between the second oblique weld lines 88*a,b* and corners 96, 98, may be welded together.

Figure 27:
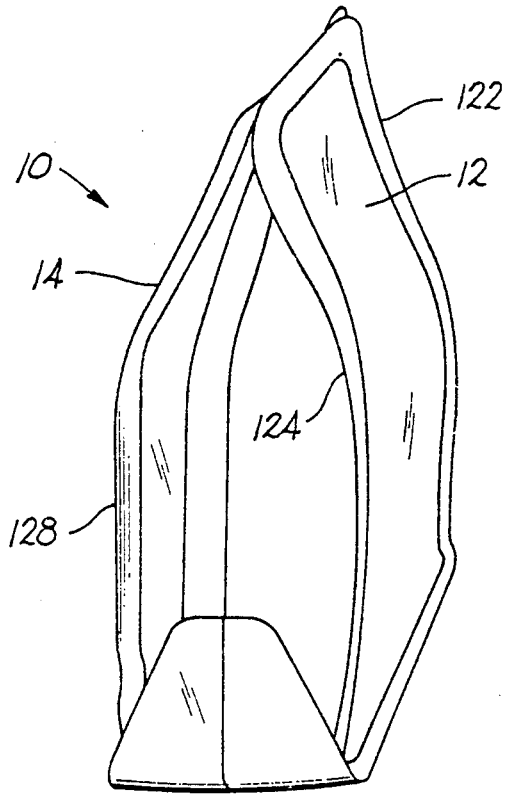
FIG. 27 is a perspective view of one embodiment of the container of the present invention having reinforced side edges.
Figure 28:
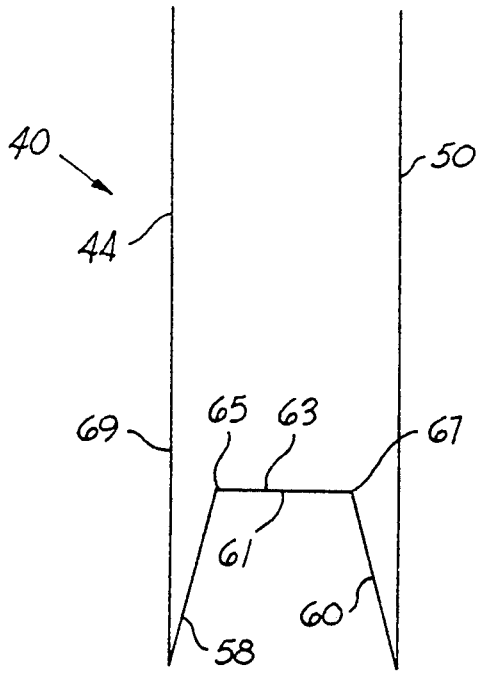
FIG. 28 is a cross-sectional view of an intermediate structure having a middle member in its V-fold section.

In an alternate embodiment of the present invention, as shown in FIG. 28, the V-fold section 56 may include a middle member 63 attached at a first end 65 to the first V-fold member 58 and at a second end 67 to the second V-fold member 60. This will eliminate the need for the first fold line 62, which may be undesirable when the container material 34 is aluminum or some other material which may be subject to flex-cracking upon folding. In this embodiment, the first oblique weld line 84 is begun at the common point 69, which corresponds to the intersection of the first side edge weld line 66 and the top edges of the V-fold members 58, 60 plus one-half the width of the middle member 63. For example, as seen in FIG. 27, if the width of the middle member 63 is 2×, as measured between first end 65 and second end 67, the common point 69 will be located a distance of 1× above the intersection of the V-fold members 58, 60 and the first side edge weld line 66. The first oblique weld line 84 will extend between the common point 69 and the lower edge 48 of the first subsection 44 at an approximately 45° angle. Similarly, the second oblique weld line 88 is provided between a common point 69, as defined above, along second side edge weld line 88 and the lower edge 48 of the first subsection 44. The remaining steps in the formation of the container 10 may be as set forth above.

Figure 9:
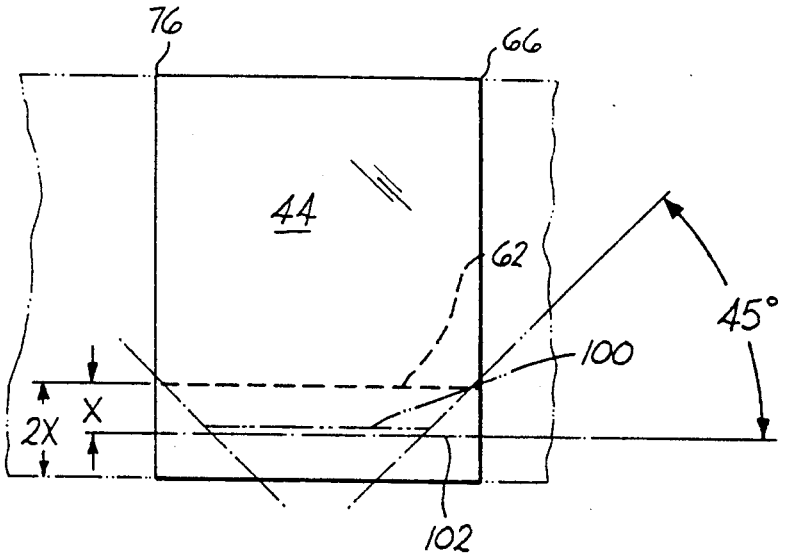
FIG. 9 is a top view of the intermediate structure illustrating the preferred position of the leg weld line.
Figure 10:
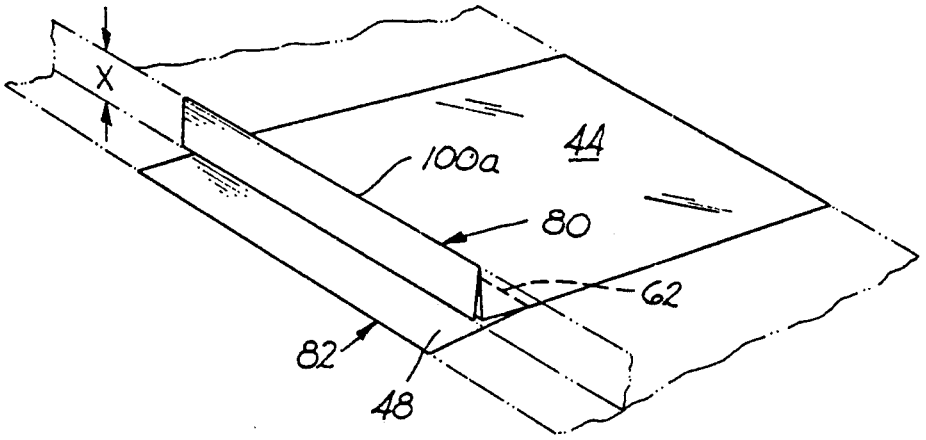
FIG. 10 is a perspective view of the intermediate structure having one leg folded.
Figure 11:
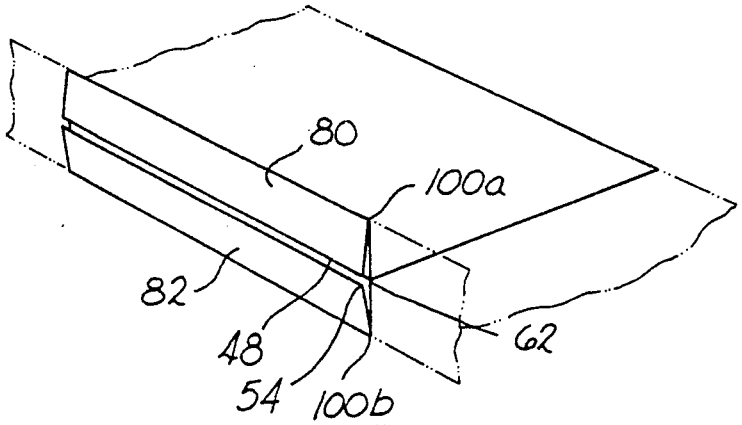
FIG. 11 is a perspective view of the intermediate structure having both legs folded.
Figure 13:
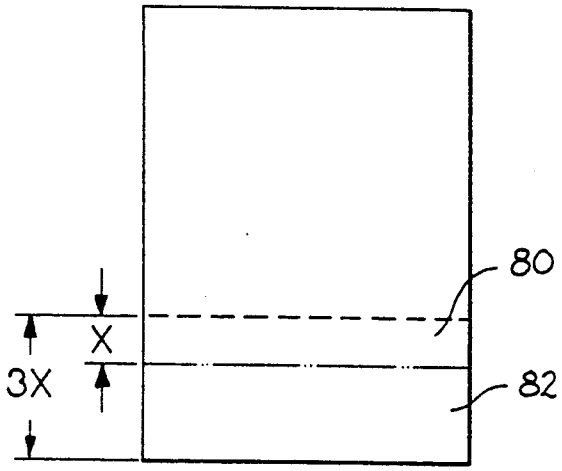
FIG. 13 is a top view of an intermediate structure wherein one leg is longer than the other.
Figure 14:
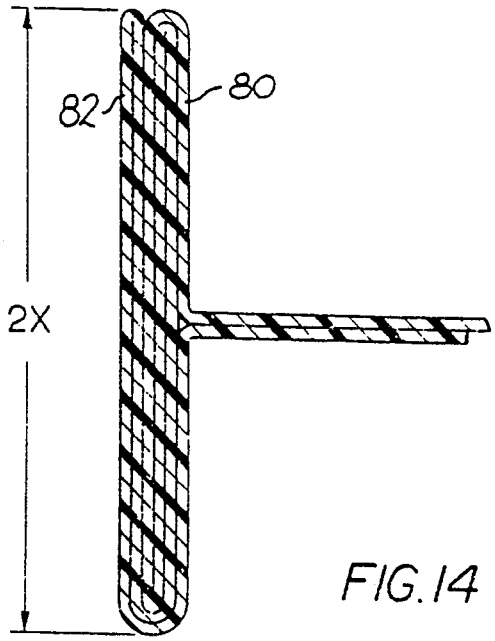
FIG. 14 is a cross-sectional view of the lower portion of the intermediate structure having legs of different sizes in folded position.
Figure 15:
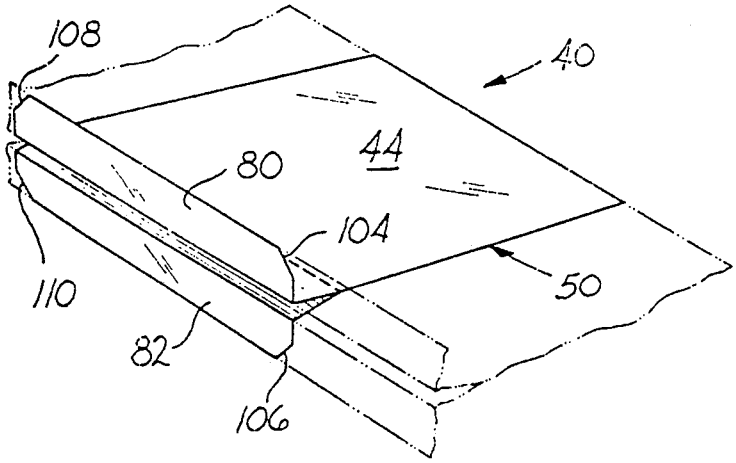
FIG. 15 is a perspective view of one embodiment of the intermediate structure having the corner portions of the legs removed.

As shown in FIG. 9, a leg weld line 100 may be made between the first side edge weld line 66 and the second side edge weld line 76 at approximately the middle line 102 of one of the legs 80, 82, resulting in weld line 100*a* on the first leg 80 and line 100*b* on the second leg. It is preferred that the line 100 be made slightly (i.e. one-sixteenth of an inch) above the midline 102 of the legs 80, 82. As shown in FIG. 10, the first leg 80 is folded along the first weld line 100*a* so that the lower edge 48 of the first subsection 44 is adjacent the first fold line 62. Similarly, as shown in FIG. 11, the second length 82 is folded along the leg weld line 100*b* so that the lower edge 54 of the second subsection 50 is adjacent the first fold line 62 and the lower edge 48 of the first subsection 44. As shown in FIG. 12, the legs 80, 82 may be maintained in folded position by adhesives or by spot-welding, such as at weld-spots 64, thereby forming bottom wall 20. In the present embodiment, the width of each leg 80, 82 will be 1×. However, as shown in FIGS. 13 and 14, the length of one leg, for example leg 82, may be greater than the length of the remaining leg 80. In such a case, the longer leg 82 is folded a plurality of times, such as illustrated in FIG. 14. Also, the legs 80, 82 may be shortened so as not to be adjacent the first fold line 62, but rather to be merely adjacent leg weld lines 100*a,b*. For example the portion of the legs 80, 82 below the leg weld lines 100*a,b* may be eliminated to provide a container 10 having a single-ply bottom 20. Also as shown in FIG. 15, the corners 104, 106, 108, 110 of the folded legs 80, 82 may be removed, such as by die cutting, for aesthetic reasons. It should be noted that even at this stage of manufacturing the structure 40 can be collapsed flat so that the first subsection 44 may be overlying the second subsection 50.

The structure 40 may be divided into individual containers 10 by cutting along the approximate midlines of the first side edge weld line 66 and the second side edge weld line 76. It is advisable that the first and second side edge weld lines 66, 76 be of sufficient width to provide an adequate seal between the first and second subsections 44, 50 after cutting. This will allow the formation of two sealed container 10 edges by a single cut.

Figure 16:
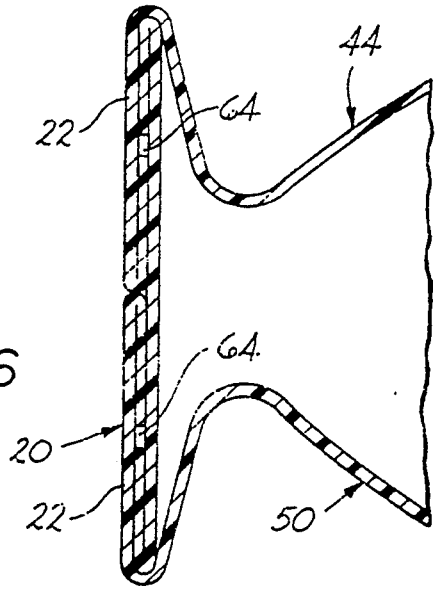
FIG. 16 is a cross-sectional view of the container of the present invention in partially opened condition.
Figure 17:
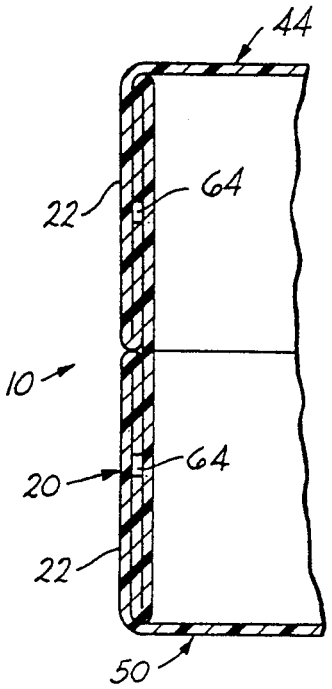
FIG. 17 is a cross-sectional view of the container of the present invention in fully opened condition.

Referring to FIGS. 12, 16 and 17, the interior space of the container 10 is provided by separating the first subsection 44 from the second subsection 50. As can be seen in FIG. 17, when the subsections 44, 50 are fully separated, the lower portion of the container 10 acquires a squared-off shape, and the bottom wall 20 will be seamless. The container 10 may be opened by a forming turret 142, such as shown in FIG. 2.

Figure 18:
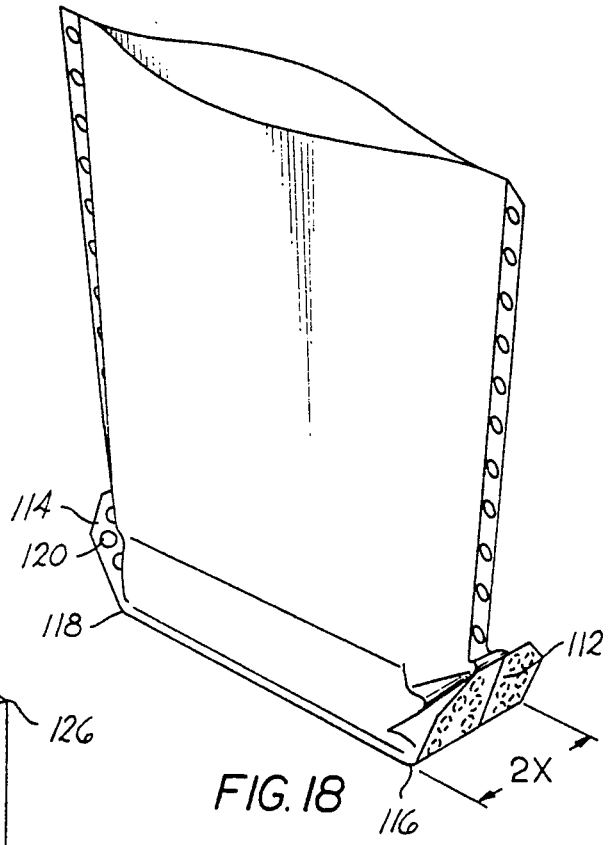
FIG. 18. is a perspective view of one embodiment of the container of the present invention having partially separated subsections.
Figure 19:
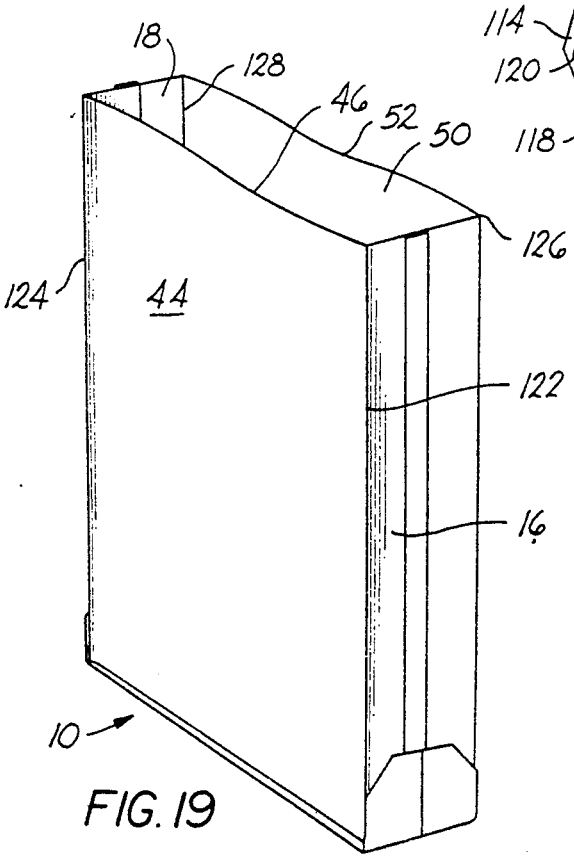
FIG. 19 is a perspective view of one embodiment of the container of the present invention having fully separated subsections.

Referring to FIG. 18, upon separation of the first subsection 44 and the second subsection 50, a first endmost portion 112 of the folded legs 80, 82 pivots upwardly along the lateral axis of the bottom wall 20 towards the first side edge weld line 66, preferably along the point 116 where the leg weld line 100 intersects the first oblique weld lines 84*a,b*. Similarly, a second endmost portion 114 of the legs 80, 82 pivots upwardly towards the second side edge weld line 76, preferably along the point 118 where the leg weld line 100 intersects the second oblique weld lines 88*a,b*. Weld-spots 120 may be provided for attaching the endmost portions 112, 114 to the side edges of the container 10, such as to the first subsection 44 and the second subsection 50. Also, as shown in FIG. 19, foldlines 122, 124 may be provided in the first subsection 44 between points 116, 118 and the upper edge 46, and foldlines 126, 128 may be provided in the second subsection 50 between points 116, 118 and the upper edge 52, for providing the container 10 with clearly defined squared-off side edges 16, 18, which will be like side walls. However, in some embodiments the side walls may not be clearly defined. The first side edge weld line 66 and the second side edge weld line 76 may be attached to the first subsection 44, such as by pinching or by weld-spots 130, to further reinforce the sidewalls 16, 18. Of course, the side edge weld lines 66, 76 may alternatively be folded in an opposite direction and attached to the second subsection 50. Also, as shown in FIG. 27, the frontwall 12 and rearwall 14 may be attached to the side edges 16, 18 along side edge foldlines 122, 124, 126, 128 to further stabilize the container 10.

Figure 20:
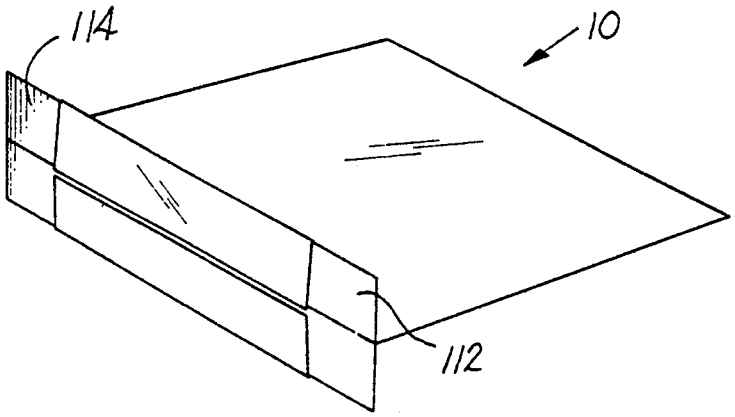
FIG. 20 is a perspective view of the intermediate structure having both legs folded and having one ply of the endmost portions of the leg removed.

Referring to FIG. 20, it may be desirable to remove one of the plies from each of the endmost portions 112, 114, such as for aesthetic reasons in instances where less reinforcement is needed at the container side walls 16, 18.

Figure 21:
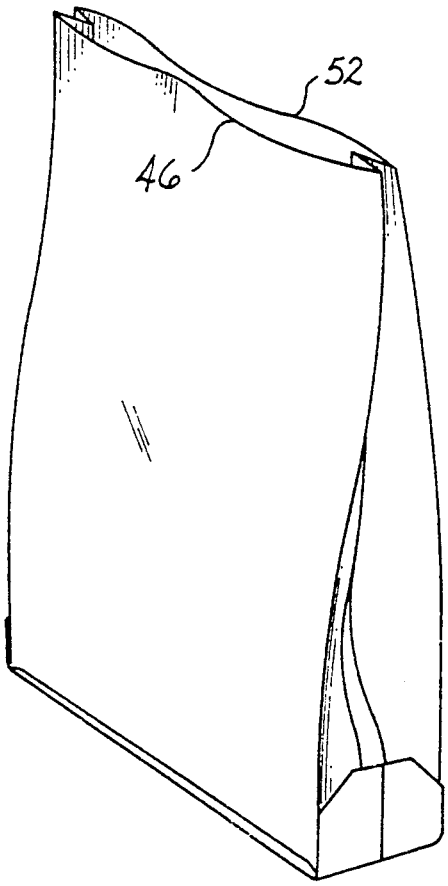
FIG. 21 is a perspective view of one embodiment of the container of the present invention having its sidewalls folded inwardly.
Figure 22:
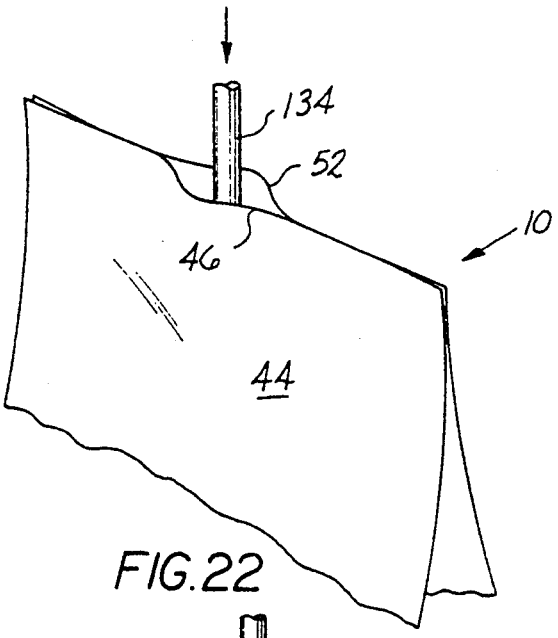
FIG. 22 is a perspective view of one embodiment of the container of the present invention having a filling nozzle inserted between its subsections.
Figure 23:
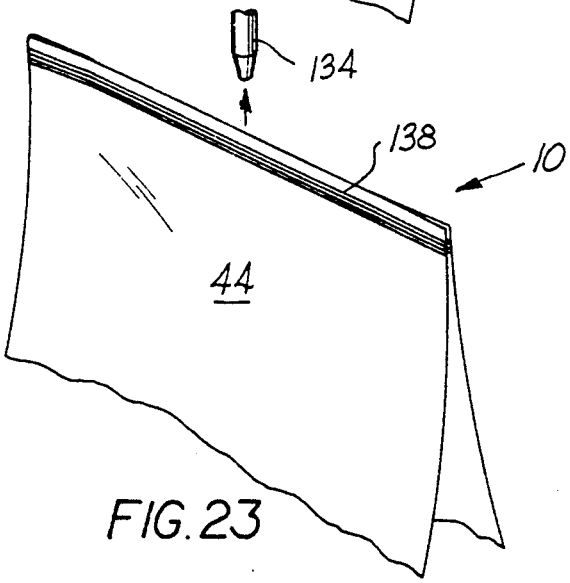
FIG. 23 is a perspective view of one embodiment of the container of the present invention having sealed top edges.
Figure 24:
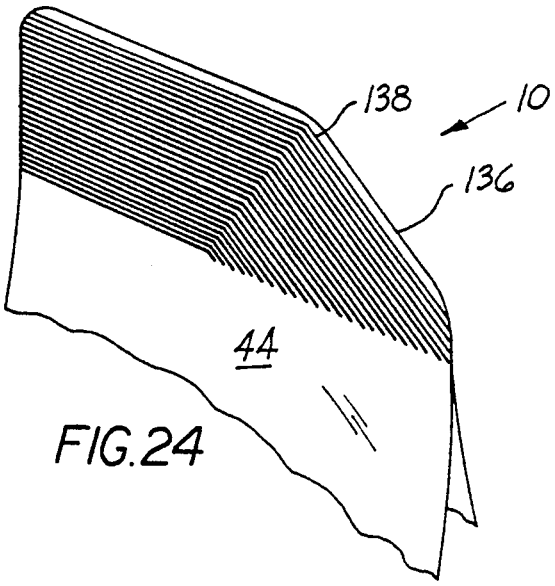
FIG. 24 is a perspective view of one embodiment of the container of the present invention having thickly sealed top edges.

Once the sidewalls 16, 18 are formed, the container 10 may be filled and sealed. This procedure may be performed on a standard filling turret 132, such as shown in FIG. 2. As shown in FIG. 21, 22 and 23, a standard filling nozzle 134 may be used to place products into the container 10. Because of its unique construction, the container 10 may be self-standing during the filling process. Once the container 10 is full, the nozzle 134 may be removed and the upper edge 46 of the first subsection 44 may be welded or otherwise sealed to the upper edge 52 of the second subsection 50, such as by a top weld line 138 The sealing of the container 10 top may be performed with the container 10 in self-standing upright position on a standard sealing turret 140. As shown in FIG. 24, the top weld line 138 may be made thick and with one corner 136 squared-off to provide an easy pouring spout for the container 10. A handle opening may be provided in it.

Figure 26:
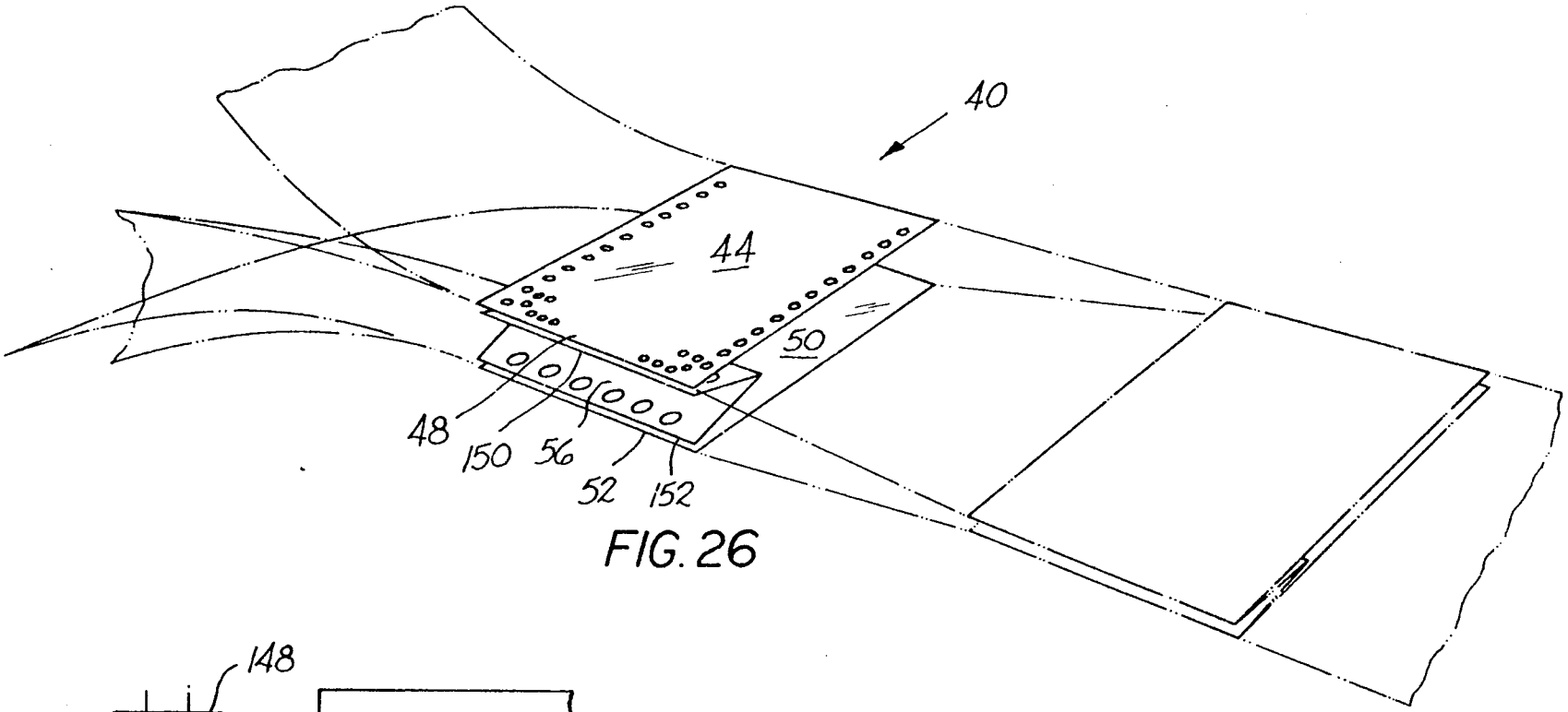
FIG. 26 is a perspective view of an intermediate manufactured structure manufactured using multiple webs of material.
Figure 25:
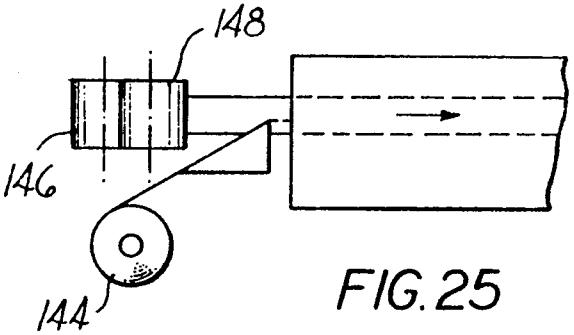
FIG. 25 is a schematic of an apparatus for manufacturing the container of the present invention from multiple webs of material.

It is also possible to manufacture the container 10 of the present invention using multiple webs. For example, as shown in FIGS. 25 and 26, the first subsection 44, the second subsection 50 and the V-fold section 56 may each be provided from separate webs 144, 146, 148 and welded or otherwise attached to form the intermediate structure 40. In such a case, the lower edge 48 of the first subsection 44 will be attached to a first edge 150 of the V-fold section 56 and the lower edge 52 of the second subsection 50 will be attached to a second edge 152 of the V-fold section 56. Once the intermediate structure 40 is formed, the remaining steps of the manufacturing process may be as set forth above or the equivalent.

Figures 52, 53, 54, 55, 56, 57:
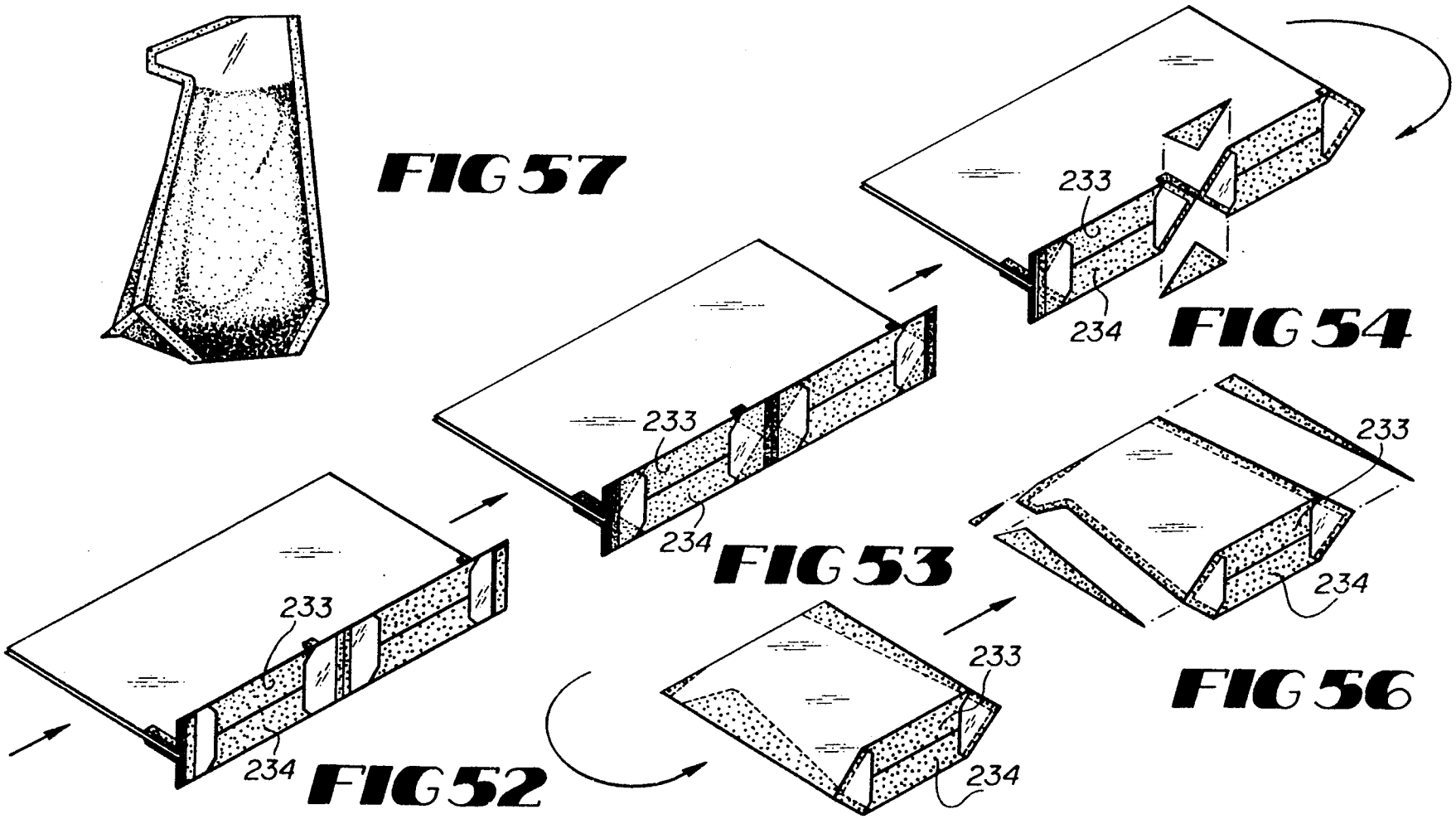
FIGS. 52–54 again show two successive portions of material in three latter stages of production.
FIGS. 55 and 56 show final stages of production on a single portion of material in producing the container illustrated in its manufactured form in FIG. 57.

With reference next to FIGS. 29–42 another method of producing a container from a sheet of flexible material is shown, the end product of which is shown in FIG. 57. The sheet of material 200 here is thermally bondable on its inside surface 201 which is shown in heavy stippling. The outside need not be thermally bondable. The sheet of material is preferably between 3 and 20 mils thick with a layer of thermally bondable polyethylene on its inside and a layer of relatively strong, relatively non-thermally bondable but stronger nylon or polyester on its outside.

Figures 29, 30, 31, 32, 33:
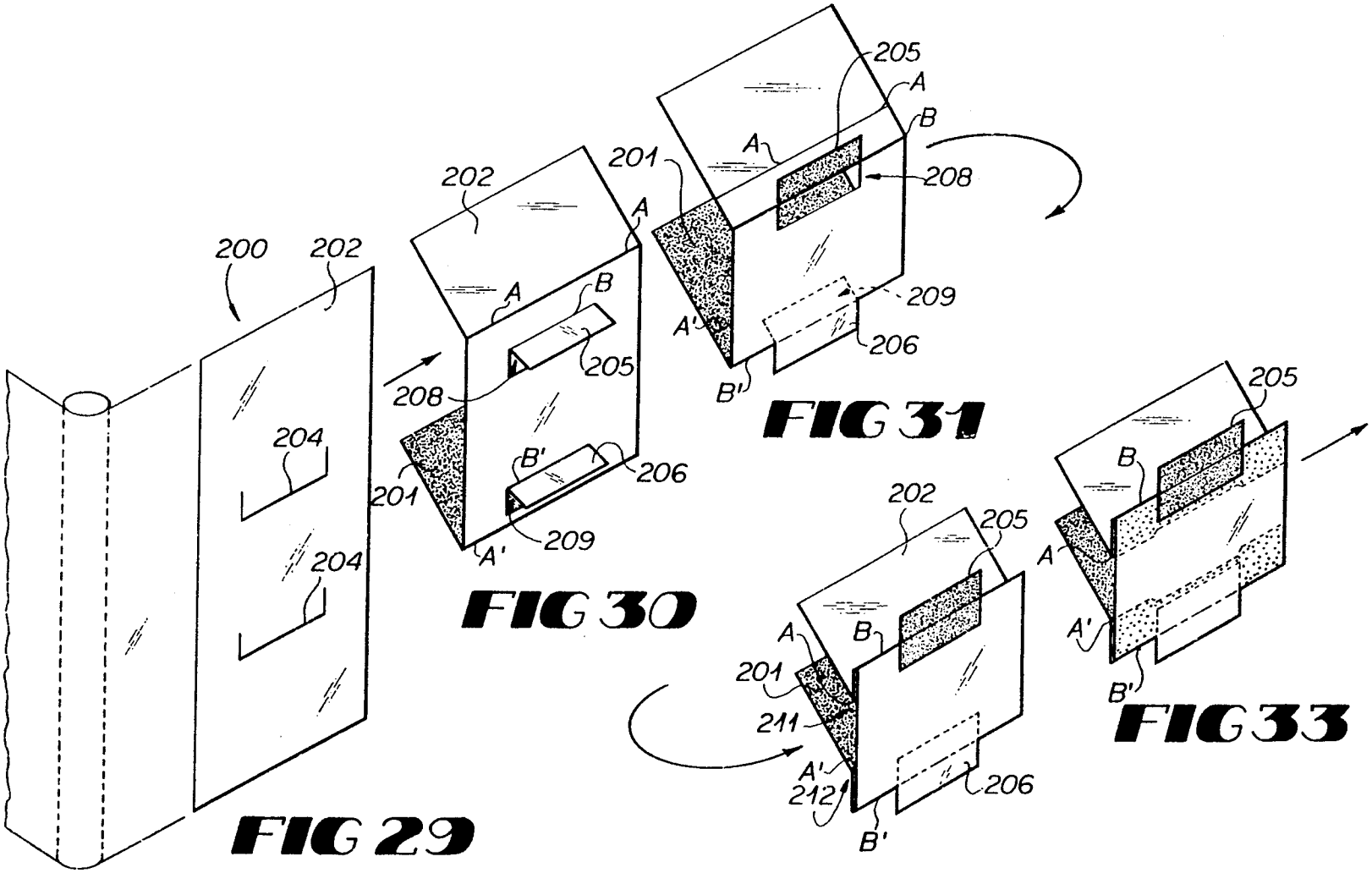
FIG. 29 is a perspective view of a portion of a continous sheet of material being advanced in an early stage of the production of a container embodying principles of the invention in another preferred form.
FIGS. 30–33 show a succession of operations performed on the section of material shown in FIG. 29 in early stages of production of the container.

As shown in FIG. 29 the continuous web of sheeting 200 is cut at single container forming intervals or portions with two U-shaped incisions 204. It should be noted that both of these are oriented in the same direction with the two legs of the U extending upwardly as shown in FIG. 29. In FIG. 30 the sheet is folded along parallel fold lines A and A' that straddle the two incisions 204. Here also it is seen that the material is folded between the ends of the legs of the two U-shaped incisions parallel to fold lines A and A' along folds B and B' to form two flaps 205 and 206. The flaps are shown here folded outwardly from the sheet to form two open windows 208 and 209 in the sheet.

Referring next to FIG. 31, the folds B and B' are seen to be extended laterally from the flaps which are shown now pivoted 180 degrees from their original positions closing the windows. Note that window 209 is now hidden from view. The material is next refolded along fold lines A and A', as shown in FIG. 32, to form two pleats 211 and 212 with the thermally bondable surfaces of the components of each pleat in intimate contact. Note also that the formation of the pleats cause the windows 208 and 209 to become closed with the thermally bondable inside surface of a pleat ply facing outwardly through the windows as bondable extensions of the inside surface of the flaps 205 and 206. The pleats are then heat sealed where indicated in FIG. 33 in light stippling. Sealed areas in all the remaining figures of the drawings are shown in light stippling.

Figures 34, 35, 36, 37, 38:
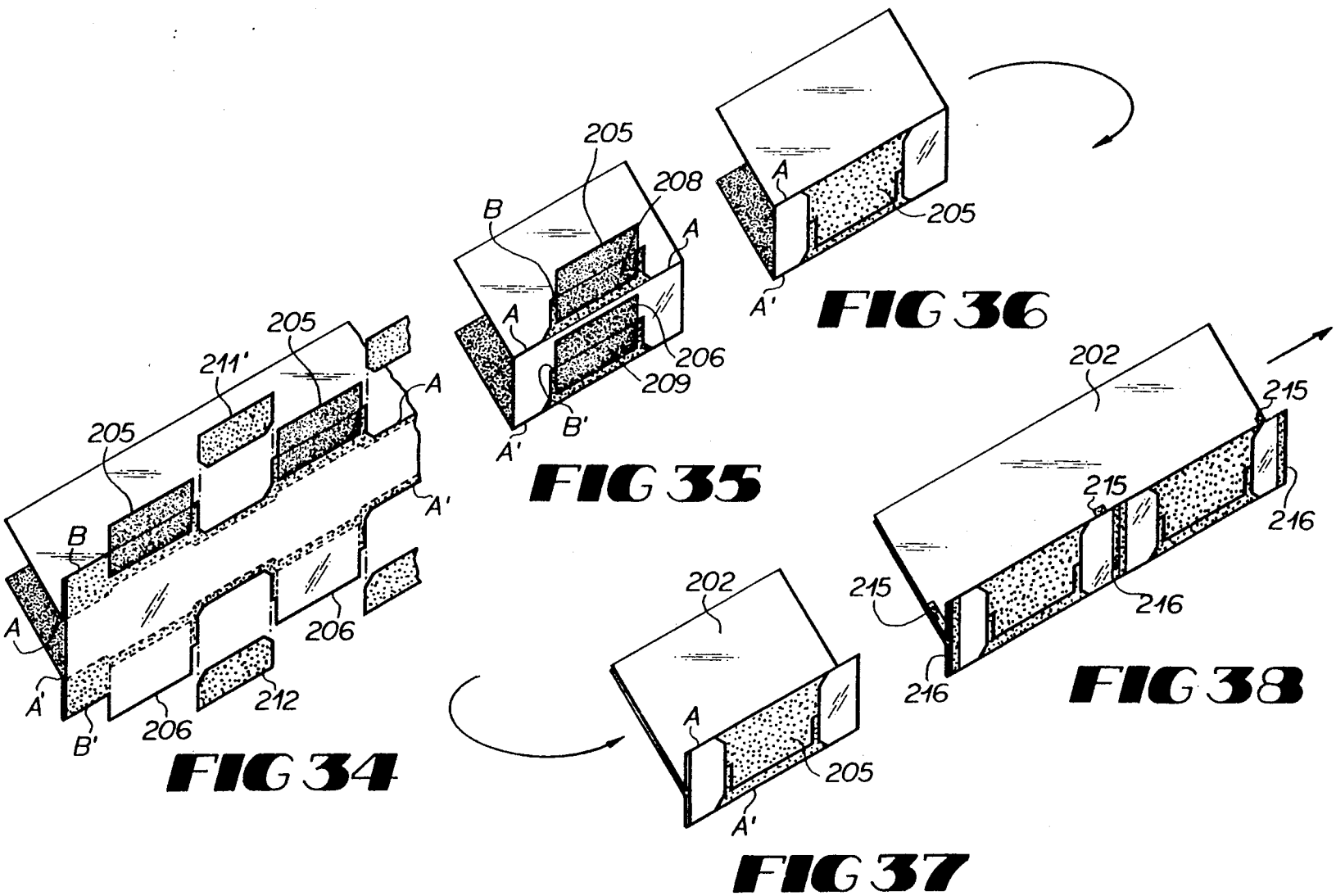
FIG. 34 shows two successive portions of the sheet for clarity in illustrating a step in removing portions of the material following the production step shown in FIG. 33.
FIGS. 35–37 illustrate two more steps formed in sequence on the single portion of material.
FIGS. 38–40 again show two successive portions of the sheet for clarity in illustrating latter stages of production.

The next step in the process is shown in FIG. 34 in which is illustrated two consecutive container forming portions of the sheet 200. Here, two segments 211' and 212' of the pleats are cut away. The flap 206 is folded towards fold A as shown in FIG. 35. The flap 205 is then folded towards fold A', as shown in FIG. 36, against the inside surface of the material that faces outwardly from window 209. This causes flap 206 also to be pressed against the material that faces outwardly from window 208. The material is then thermally bonded where shown by the light stippling of FIG. 36. This area forms a reinforced, double wall bottom of the container.

Figures 39, 40, 41, 42:
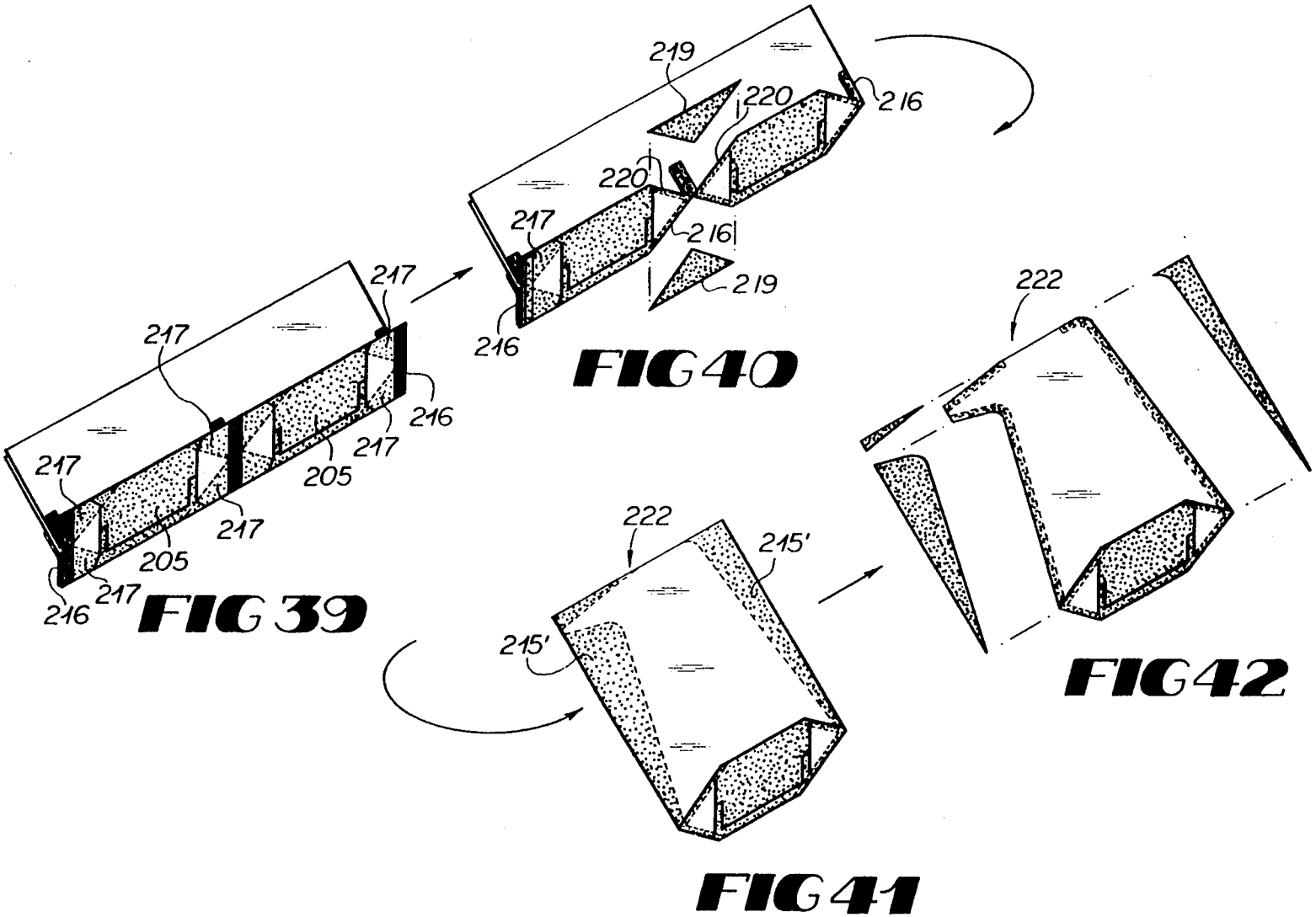
FIGS. 41 and 42 illustrate final steps in producing the container, the produced container which is shown in FIG. 57.

The next step in the process is shown in FIG. 37 where the material is formed into the shape of a T by folding the sheet 200 along two folds above and parallel with fold lines A and A'. This brings opposed inside surfaces 201 of the sheet against each other. Side edge seals 215 and bottom seals 216 are then formed by thermal bonding as shown by the light stippling in FIG. 38. Diagonal seals 217 are now also formed in the pleats aside the flaps as shown in FIG. 39. Triangular segments 219 of the sealed pleats are then cut away as shown in FIG. 40 leaving only thin convergent seals 220 extending convergently from the double wall container bottom.

Finally, side seal extensions 215' are formed by thermal bonding in a pattern specifically designed for the container sides as shown in FIG. 41 and excess material cut away as shown in FIG. 42. This leaves only a center portion 222 unsealed to provide an opening in the top of the container. Once filled with a supply of liquid or granular material, the flexible container assumes the shape shown in FIG. 57.

It should be noted that in the procedure just described that no fold or crease is created in the interior or exterior of the container bottom. This is a very important feature of the process since it avoids the risk of material fracture, particularly where thin plastic films or foils are used. It should also be appreciated that all of the seals or welds are made with the inner, sealant layers in intimate contact.

Figures 43, 44, 45, 46, 47:
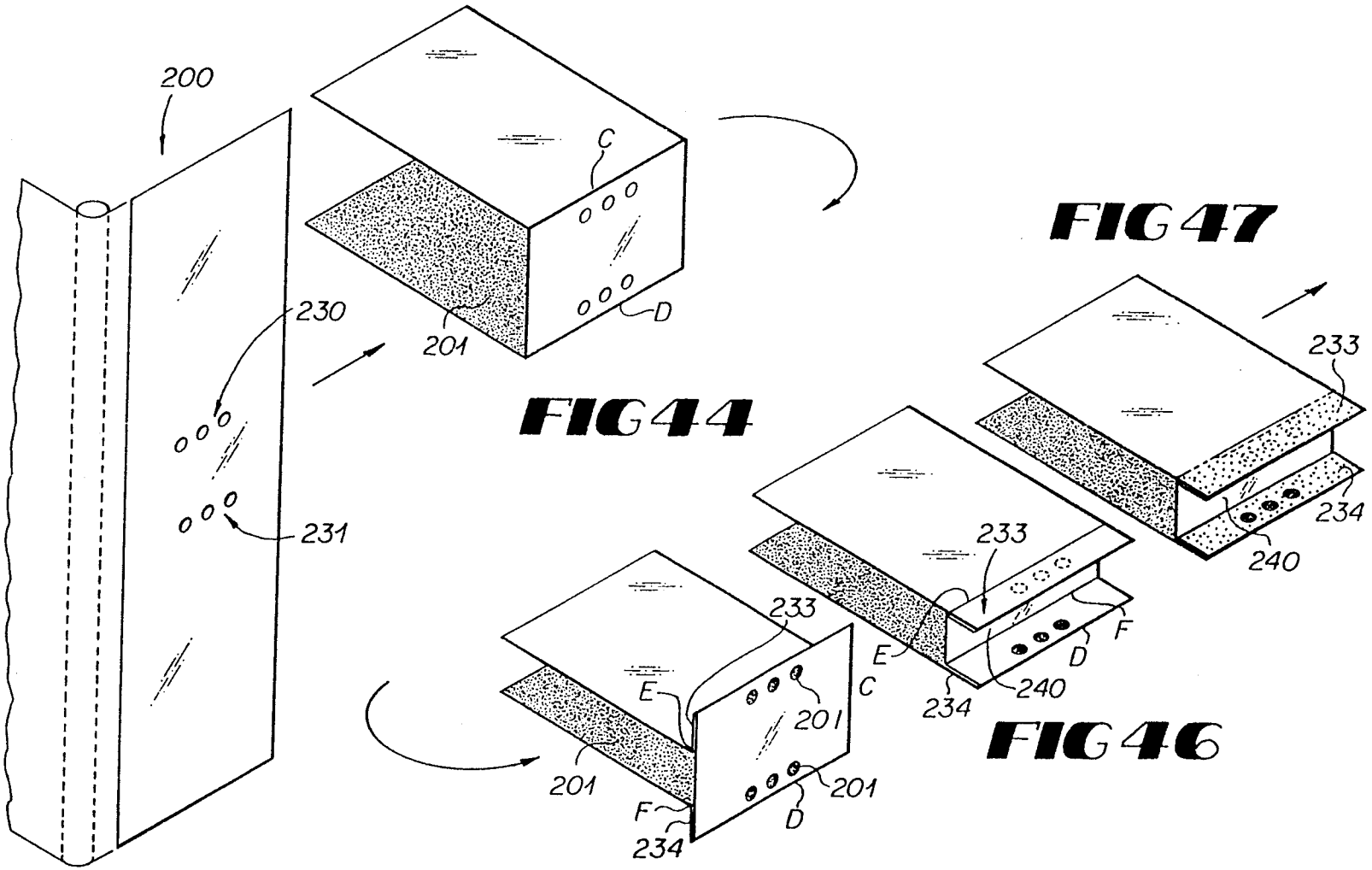
FIG. 43 is a perspective view of a portion of the same continuous sheet of material 200 being advanced in an early stage of the production of a container embodying principles of the invention in yet another preferred form.
FIGS. 44–47 show a succession of operations performed on the section of material shown in FIG. 43 in early stages of production of the container.

A modified form of the procedure just described and illustrated in FIGS. 29–42 is shown in FIGS. 43–56 in forming the container shown in FIG. 57, with only the unshown bottom of the container differing in structural detail. An important difference here is that the same sheet of material 200 is formed with two set of holes 230 and 231 instead of with the flaps and windows. The sheet is folded along parallel fold lines C and D as shown in FIG. 44 and again along folds E and F as shown in FIG. 45 to form two pleats 233 and 234. Again, the thermally bondable, inside surfaced of the pleat portion of the sheet are in intimate contact and an inside surface 201 closes and faces outwardly from the holes 230 and 231.

Figure 50:
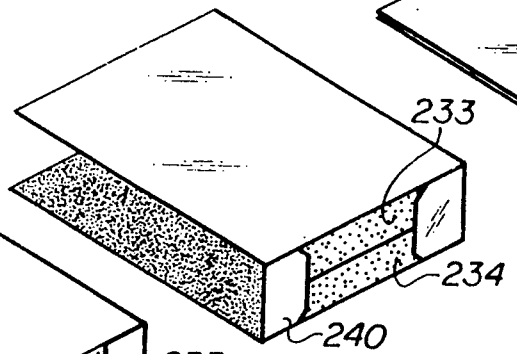
Figure 49:
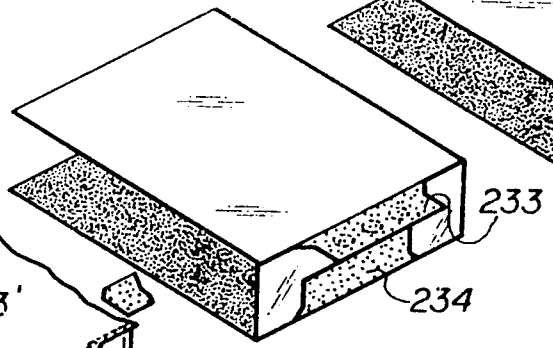
Figure 48:
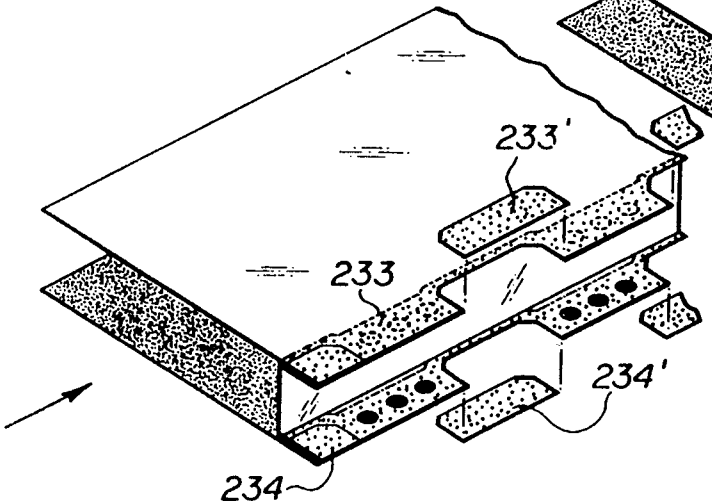
FIG. 48 shows two successive portions of the sheet for clarity in illustrating a step in removing portions of the material following the production step shown in FIG. 47.

The pleats 233 and 234 are next folded into a parallel relation as shown in FIG. 46 and bonded as shown in FIG. 47. Pleat segments 233' and 234' are cut away as shown in FIG. 48. The remaining portions of the pleats 233 and 234 are then folded against the outside surface of a bottom portion 240 as shown in FIG. 50. This brings the inside surface 201 of the sheet that faces outwardly through the holes 230 and 231 against the bottom portion 240 and thermal bonds are then made. This serves to form a triple layered reinforced container bottom.

Figure 51:
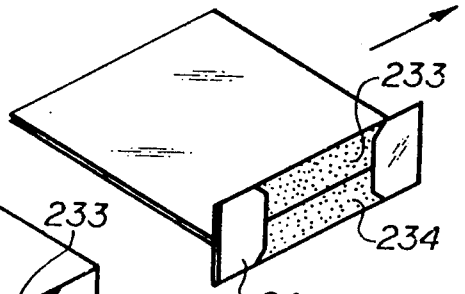
FIGS. 49–51 show three intermediate stages of production, in sequence.

The material is then formed into the shape of a T as shown in FIG. 51 and side edge seals again made. The remainder of the process is essentially the same as that that was desribed in conjunction with FIGS. 38–41, as shown in FIGS. 53–57. Again, with this procedure no folds or creases are formed in the bottom of the container as with most of the prior art procedures using V folds and gussets. However, here seals are made between the inside and outside of the material.

While this invention has been described in detail with particular reference to the preferred embodiments thereof, it will be understood that variations and modifications can be effected within the spirit and scope of the invention as previously described and as defined in the claims. For example, the sequence of the steps set forth herein may be altered, and welds may be accomplished by lines of adhesive or other attachment means. As an alternative to the method of mass producing containers 10 set forth above, each individual container 10 may, using the method of the present invention, be produced from a single sheet of material rather than from a continuous web. Therefore, while the above description contains many specificities, these should not be construed as limitations on the scope of the invention, but rather as an amplification of one preferred embodiment thereof.

I claim:

1. A method of producing a container from a sheet of flexible material having a thermally bondable inside surface, and with the method comprising the steps of cutting the material to form two flaps; folding the flaps outwardly from the sheet to form two windows in the sheet; forming and thermally bonding two portions together of each of two pleats from which two folds of the sheet extend to form the container sides, the pleats transversing the windows so that one ply of each pleat closes a window; folding the pleats to bring inside surfaces of the flaps against the window closing pleat plies; thermally bonding the flaps to the window closing pleat plies thereby forming a thermally bonded double wall container bottom; and thermally bonding together side edge portions of the two container side forming folds.

2. The method of claim 1 wherein two diagonal bonds are heat sealed in the two pleats to each side of the flaps.

3. A container formed in accordance with the method of claim 1.

4. The container of claim 3 wherein the outside surface of the sheet of material is thermally non-bondable to itself.

5. A method of producing a container from a sheet of flexible material having a thermally bondable inside surface, and with the method comprising the steps of cutting the material to form at least two holes therein; forming and thermally bonding two pleats with each pleat having a ply that overlays and closes one of the holes and with the pleats straddling a container bottom portion of the sheet and from which pleats two sheet folds extend to form the container sides; folding the pleats onto the sheet bottom portion and thermally bonding that portion of the pleat plys that close the holes to the container bottom portion thereby forming a thermally bonded triple wall container bottom; and thermally bonding together side edge portions of the container side forming folds.

6. The method of claim 5 wherein two diagonal bonds are heat sealed in the two pleats to each side of the hole of each pleat.

7. A container formed in accordance with the method of claim 5.

8. The container of claim 7 wherein the outside surface of the sheet of material is thermally non-bondable to itself.

* * * * *